US006003501A

United States Patent [19]

Shimazaki et al.

[11] Patent Number: 6,003,501

[45] Date of Patent: Dec. 21, 1999

[54] FOUR-CYCLE ENGINE FOR OUTBOARD MOTOR

[75] Inventors: Wataru Shimazaki; Sadafumi Shidara; Kouichi Oka; Masaki Tsunoda, all of Wako, Japan

[73] Assignee: Honda Giken Kogyo Kabushiki Kaisha, Japan

[21] Appl. No.: 09/150,783

[22] Filed: Sep. 10, 1998

[30] Foreign Application Priority Data

Sep. 12, 1997 [JP] Japan ..... 9-248432

[51] Int. Cl.[6] ..... B63H 21/32; F02B 25/00

[52] U.S. Cl. ..... 123/572; 440/88

[58] Field of Search ..... 123/572, 574, 123/195 R, 41.86, 196 W; 440/89, 88, 900

[56] References Cited

U.S. PATENT DOCUMENTS 5,501,202 3/1996 Watanabe ..... 123/572

5,514,015 5/1996 Okazawa et al. ..... 440/88

5,794,602 8/1998 Kimura ..... 123/572

5,951,344 9/1999 Tsunoda et al. ..... 440/89

FOREIGN PATENT DOCUMENTS 5214921 8/1993 Japan .

*Primary Examiner*—Noah P. Kamen
*Assistant Examiner*—Hai Huynh
*Attorney, Agent, or Firm*—Adams & Wilks

[57] ABSTRACT

A four-cycle engine for an outboard motor includes an upwardly extending breather chamber which communicates with a projecting portion provided at a lower part of a crankcase and with an induction system via a PCV passage for returning a blow-by gas to intake manifolds. With this arrangement, it becomes possible to remove oil components from the blow-by gas within the PCV passage and hence to return the substantially oil-free blow-by gas to the intake manifolds.

3 Claims, 9 Drawing Sheets

FOUR-CYCLE ENGINE FOR OUTBOARD MOTOR

BACKGROUND OF THE INVENTION

1. Field of the Invention

The present invention relates generally to a four-cycle engine for an outboard motor and, more particularly, to an engine structure suitable for separation of oil in a PCV (positive crankcase ventilation) passage of a blow-by gas returning structure.

2. Description of the Related Art

An outboard motor employing a PCV system has been proposed in Japanese Patent Laid-Open Publication No. HEI-5-214921.

The proposed outboard motor has a crankcase and an intake tube communicating therewith through a hose so as to introduce a fresh air into the crankcase. In the outboard motor, a blow-by gas is supplied from a breather chamber provided sidewardly of a cylinder head to intake manifolds.

Since the cylinder head includes therein many lubricated parts such as cams, camshafts and valve rocker arms to which a lubricating oil is supplied, a large amount of oil mist is contained therein. Such an arrangement is not suitable for separating an oil from a blow-by gas within the breather chamber.

Apart from the related art described above, there is also proposed an outboard engine having a breather chamber disposed below a carburetor provided alongside the engine. However, since the breather chamber is positioned below the carburetor, the height of the breather chamber is restricted from extending vertically from an opening into which a blow-by gas flows. It is therefore difficult to obtain a breather chamber having a configuration suitable for separating an oil from a blow-by gas sufficiently, thereby requiring other breather chambers and an oil returning passage for returning an oil from the breather chamber to an oil pan. Thus, the engine is complicated in construction to thereby increase the number of parts thereof and hence the number of assembling steps, leading to increased coats of production.

SUMMARY OF THE INVENTION

The present invention has been attained so as to solve the foregoing problems and its object is therefore to provide a four-cycle outboard motor which is capable of separating an oil from a blow-by gas in a PCV passage with a simple structure and which allows for layout of a breather chamber of which construction is also simple.

According to a first aspect of the present invention, there is provided a four-cycle engine for an outboard motor, which has a crank room for accommodating a substantially vertically disposed crankshaft, a cylinder block having an axis extending substantially horizontally, a crankcase formed of two halves and coupled to the cylinder block, a cylinder head coupled to the cylinder block, a head cover coupled to the cylinder head to form a cam chamber for housing therein a substantially vertically disposed camshaft driven by the crankshaft, an induction passage having a throttle valve and communicating with combustion chambers formed at least partially by the cylinder head, and an oil pan provided below at least the cylinder block and communicating with the crank room and the cam chamber for storing a lubricating oil from the crank room and the cam chamber, the four-cycle engine comprising: a breather passage formed in the cylinder block and the cylinder head and communicating the crank room and the cam shaft with each other; a fresh air introducing passage for supplying a fresh air to the crank room via the breather passage provided in the cylinder block with one end thereof communicating with the cam chamber and the other end thereof communicating with the induction passage; a projecting portion disposed at a side of a lower half of the cylinder block and having an inside of recessed configuration opening to a bottom surface of the cylinder block and communicating with the oil pan; a breather chamber disposed sidewardly of the cylinder block and above the projecting portion and extending upwardly to communicate with the inside of the projecting portion through an opening provided in the projecting portion; and a PCV passage communicating with an upper portion of the breather chamber and with the induction passage which communicates with the combustion chambers formed at least partially by the cylinder head.

The breather chamber communicating with the PCV passage is provided in such a manner as to extend upwardly. Also, the breather chamber is constructed such that a blow-by gas within the crank room is introduced thereinto from the projecting portion provided at the lower half of the cylinder block, thereby effecting removal or separation of oil components in the blow-by gas.

Further, since the crank room communicates with the cam chamber through the breather passage, it becomes possible to reduce a change in pressure within the crank room.

The breather chamber extends upwardly and it therefore may be directed vertically. The breather chamber introduces a blow-by gas thereinto from the projecting portion provided at the side of the cylinder block. Such a projecting portion separates or removes oil components from the blow-by gas. Moreover, since the breather chamber has a height suitable for removing or separating the oil components from the blow-by gas as the blow-by gas flows upwardly. Consequently, it becomes possible to obtain a blow-by gas returning PCV passage exceedingly suitable for separating the oil from the blow-by gas. Also, the breather chamber can be provided along the height of the cylinder block and therefore the height of the breather chamber enables the separation of the oil components from the blow-by gas with the result that the oil components are prevented from flowing into the intake manifold. The breather chamber can also be set to have a large entrance. With the enlarged entrance, the oil components can be smoothly discharged.

Accordingly, it becomes possible to enlarge the entrance as much as possible and hence the entrance can double in function as an introducing portion for a blow-by gas and as a discharge portion for an oil, thereby requiring no check valves.

As is apparent from the foregoing description, it is not necessary to provide a plurality of breather chambers so as to separate the oil from the blow-by gas. The simple construction comprising the upwardly extending breather chamber and the projecting portion provided at the cylinder block with the recessed portion communicating with the crank room makes it possible to obtain a blow-by gas returning type engine suitable for removing or separating the oil from the blow-by gas.

Further, since the breather chamber does not open toward the cam chamber directly or the vicinity of the cam chamber, the PCV passage can prevent the oil component from entering the intake manifold.

In a specific form of the invention, the induction passage is disposed sidewardly of the cylinder block in such a manner as to extend over an area from the cylinder head to the crankcase, whilst the breather chamber is disposed internally of the induction passage.

With the breather chamber positioned between the cylinder block of the engine and the induction passage, it becomes possible to avoid interference of the breather chamber with the induction passage. As a result, the breather chamber can be readily disposed in a small space of the engine of the outboard motor.

In a further specific form of the invention, the breather chamber is formed by welding halved members made of resin.

With this arrangement, the breather chamber can be readily manufactured. Also, the members are shaped from resin and hence it becomes possible to easily provide, in place, walls for separating an oil from a blow-by gas within the breather chamber. Accordingly, the breather chamber suitable for separating the oil components from the blow-by gas can be easily obtained.

BRIEF DESCRIPTION OF THE DRAWINGS

A preferred embodiment of the present invention will hereinafter be described in detail, by way of example only, with reference to the accompanying drawings, in which.

DETAILED DESCRIPTION OF THE PREFERRED EMBODIMENT

The following description is merely exemplary in nature and is in no way intended to limit the invention or its application or uses.

Figure 1:
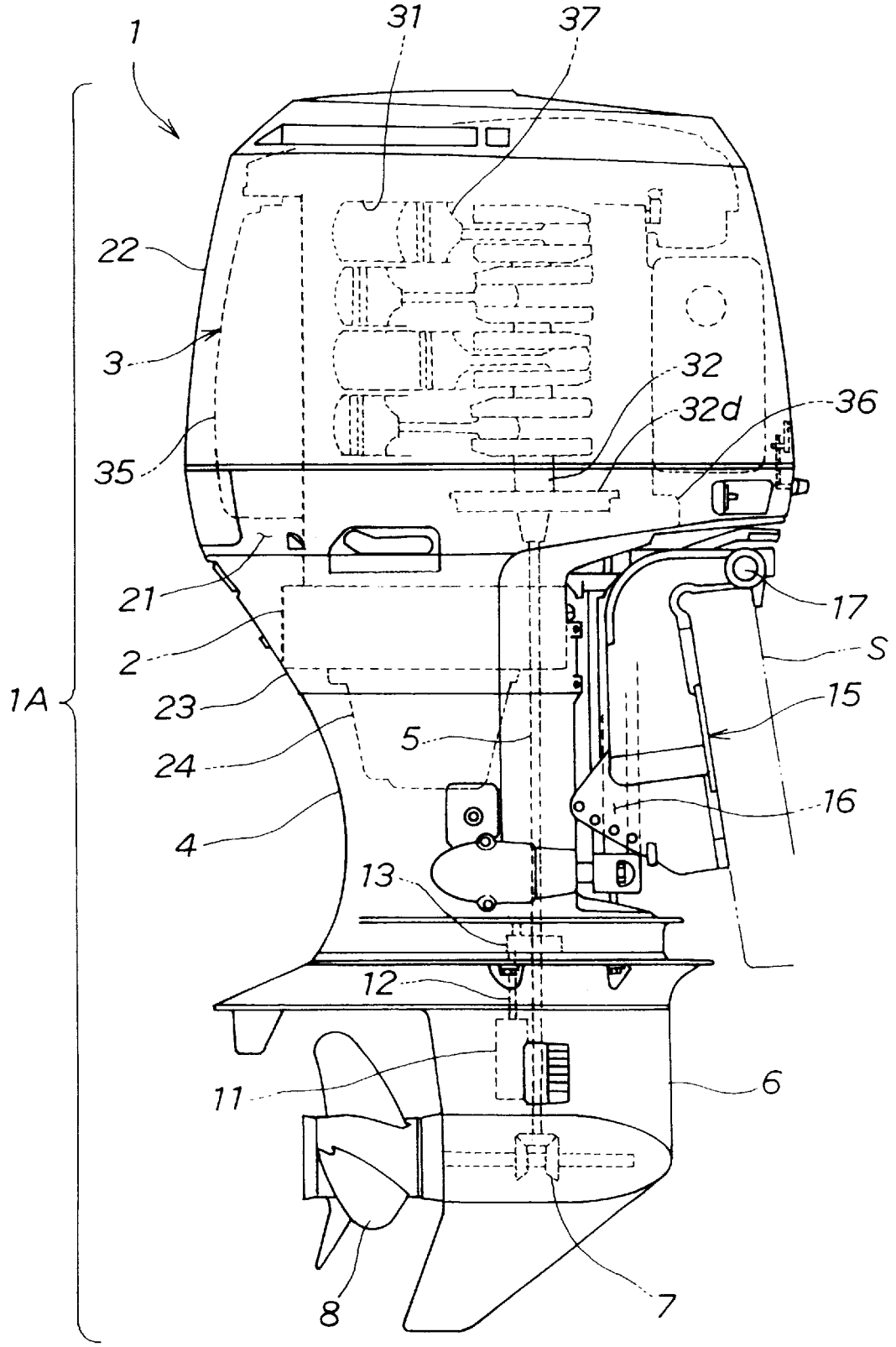
FIG. 1 is a side view of an outboard motor having a four-cycle engine according to the present invention.

Referring to FIG. 1, there is shown an outboard engine or motor 1 according to the present invention. The outboard motor 1 generally comprises an outboard motor body 1A and an outboard motor attachment mechanism 15 for attaching the outboard motor body 1A to the stern of a hull S.

The outboard motor body 1A includes a mount case (engine support case) 2, a vertical multi-cylinder four-cycle engine 3 carried on and bolted to the mount case 2, and an extension case 4 bolted to the bottom of the mount case 2 and defining therein an exhaust expansion chamber. A vertical shaft 5 extends vertically through an internal space of the extension case 4 for transmitting rotational power of the engine 3 to a propeller 8. A gear case 6 is connected to a lower end of the extension case 4 and houses therein a bevel gear set 7 operatively connected with a dog clutch (not shown) for switching or changing over the forward and reverse rotation of the propeller 8 to move the hull S forwardly or backwardly. The bevel gear set 7 has an output shaft to which the propeller 8 is firmly connected so that the propeller 8 is rotatably driven by the engine power transmitted via the vertical drive shaft 5. The gear case 6 also houses a cooling water screen 11 which is connected by a cooling water supply pipe 12 to a water pump 13 disposed in the internal space of the extension case 4.

The outboard motor attachment 15 is a fixture assembly used for securing the outboard motor body 1A to the stern of the hull S, with a mount rubber disposed between the stern and the attachment mechanism 15. The attachment mechanism 15 supports the motor body 1A such that the motor body 1A can swing in the lateral direction about a vertical swivel shaft 16 and can tilt up and down about a horizontal tilt shaft 17.

The outboard motor body 1A further has an undercase 21, an engine cover 22 mounted on the undercase 21 and cooperating with the latter to receive therein the engine 3, and an undercover 23 disposed directly below the undercase 21 and surrounding the mount case 2 and an upper end portion of the extension case 4.

More specifically, the undercase 21 is mounted on an upper end portion of the mount case 2 and bolted to the latter. The undercase 21 and the engine cover 22 are detachably connected together by a lock mechanism with the engine cover 22 carried on the undercase 21. The undercase 21 has a lower end bolted to an upper end of the undercover 23.

The undercass 21 and the engine cover 22 serve as an engine case defining therein an engine room in which the engine 3 is received. The undercover 23 has the function of a decorative or ornamental cover. An oil pan 24 is connected to the bottom of the mount case 2.

The engine 3 will be described in detail with reference to FIGS. 2 and 3. The vertical multi-cylinder four-cycle engine 3 comprises, for example, a water cooled four-cylinder engine with four cylinders 31 disposed horizontally in vertical juxtaposition and a crankshaft 32 extending vertically.

Thus, both the joining plane at which a cylinder block 33 and a cylinder head 34 meet and the joining plane at which the cylinder head 34 and a head cover 35 meet stand substantially vertically.

The engine 3 is disposed with its cylinder head 34 and head cover 35 located rearwardly (left side in FIG. 1) of the outboard motor 1. Reference numeral 36 denotes a crankcase bolted to the cylinder block 33. Designated by reference numeral 37 is a piston in each cylinder 31.

The cylinder block 33 and the crankcase 36 jointly define a crank room A for accommodating therein a crankshaft 32 while the cylinder head 34 and the head cover 35 jointly define a cam chamber B for housing therein a camshaft 38. The camshaft 38 is vertically disposed in parallel to the crankshaft 32.

The crankshaft 32 includes a top portion extruding upwardly from the joining plane at which the cylinder block 33 and the crankcase 36 meet. At an upper end of the crankshaft 32, there are provided a first pulley 32*a* for driving the camshaft 38, a second pulley 32*b* and a third pulley for driving an AC generator (ACG) 41.

Referring again to FIG. 1, a flywheel 38 with a ring gear is provided at a lower part of the crankshaft 32. Such a ring gear is driven by a starter motor to actuate the engine 3.

The undercase 21 is secured through a rubber vibration isolator 27 to the mount case 2 by a bolt 28.

Figure 2:
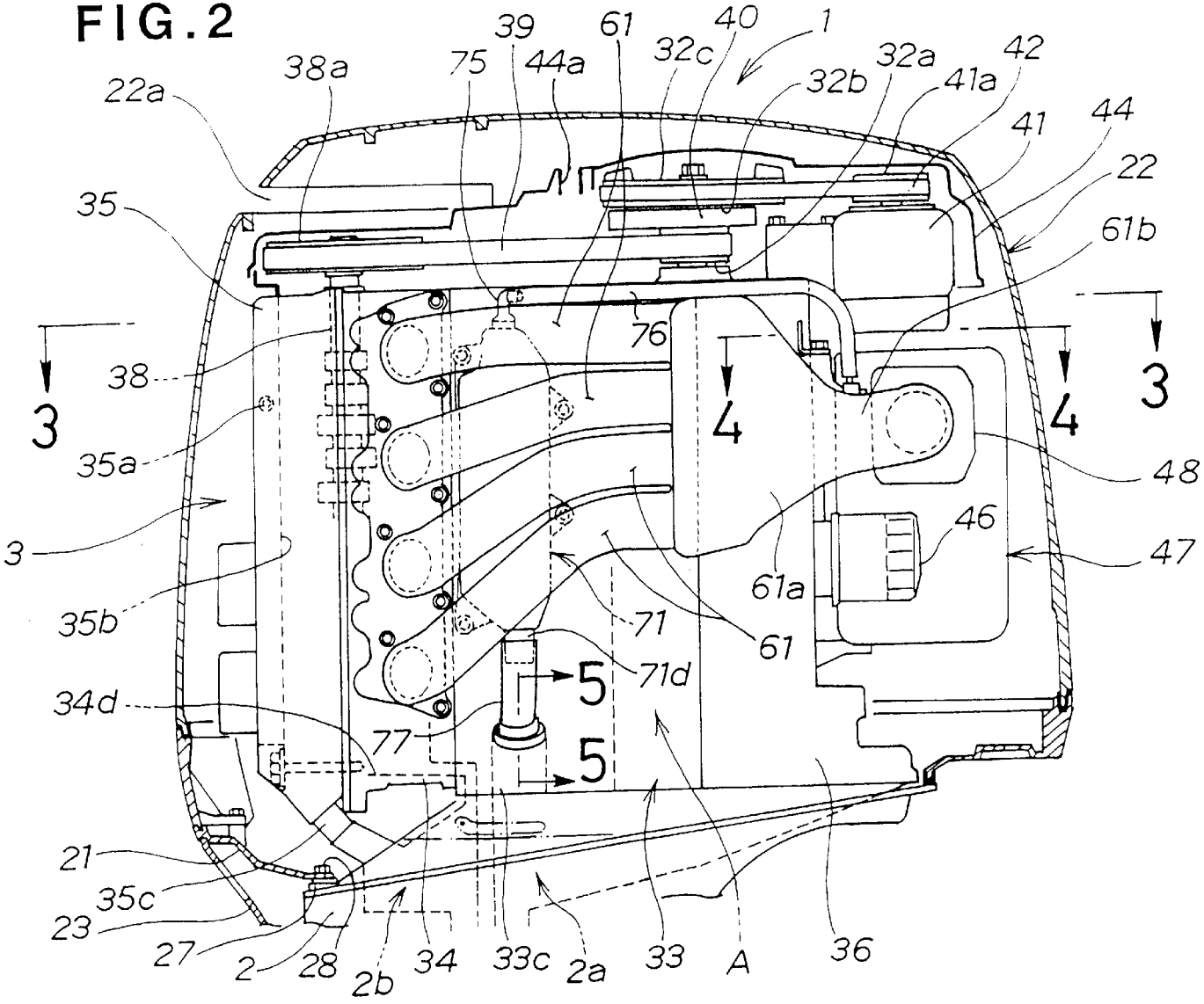
FIG. 2 is a side view of the four-cycle engine with an engine cover removed.

The engine cover 22 has an air intake hole 22*a* formed at an upper portion thereof as shown in FIG. 2. Reference numeral 39 designates a first belt for connecting a driven pulley 38*a* provided at an upper end Of the camshaft 38 to the first pulley 32*a*; 40, a second belt; 42, a belt for connecting a driven pulley 41*a* provided on the AC generator 41 to the third pulley 32*c*; and 44, a belt cover. At an upper portion of the belt cover 44, there is formed a ventilating hole or opening 44*a* for expelling an air inside the belt cover 44 out of the engine cover 22.

Figure 4:
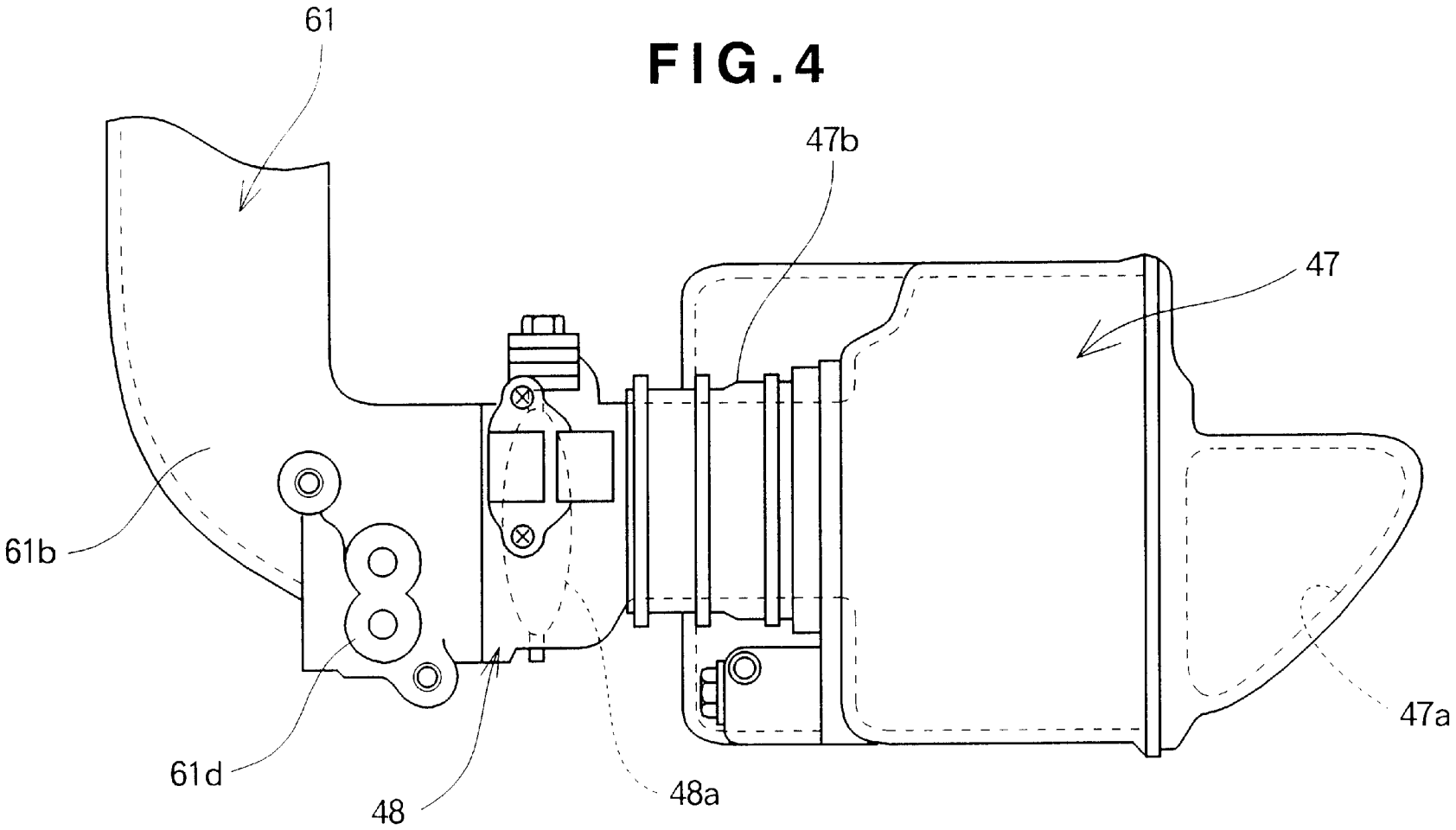
FIG. 4 is an enlarged view taken in the direction of line 4—4 of FIG. 2.

Reference numeral 46 denotes an oil filter. Designated by reference numeral 47 is an induction box disposed outside the crankcase 36 and positioned forwardly of the outboard motor 1. The induction box 47 defines an induction room therein, Reference numeral 48 denotes a throttle valve device including therein a throttle valve 48*a* as shown in FIG. 4.

Figure 3:
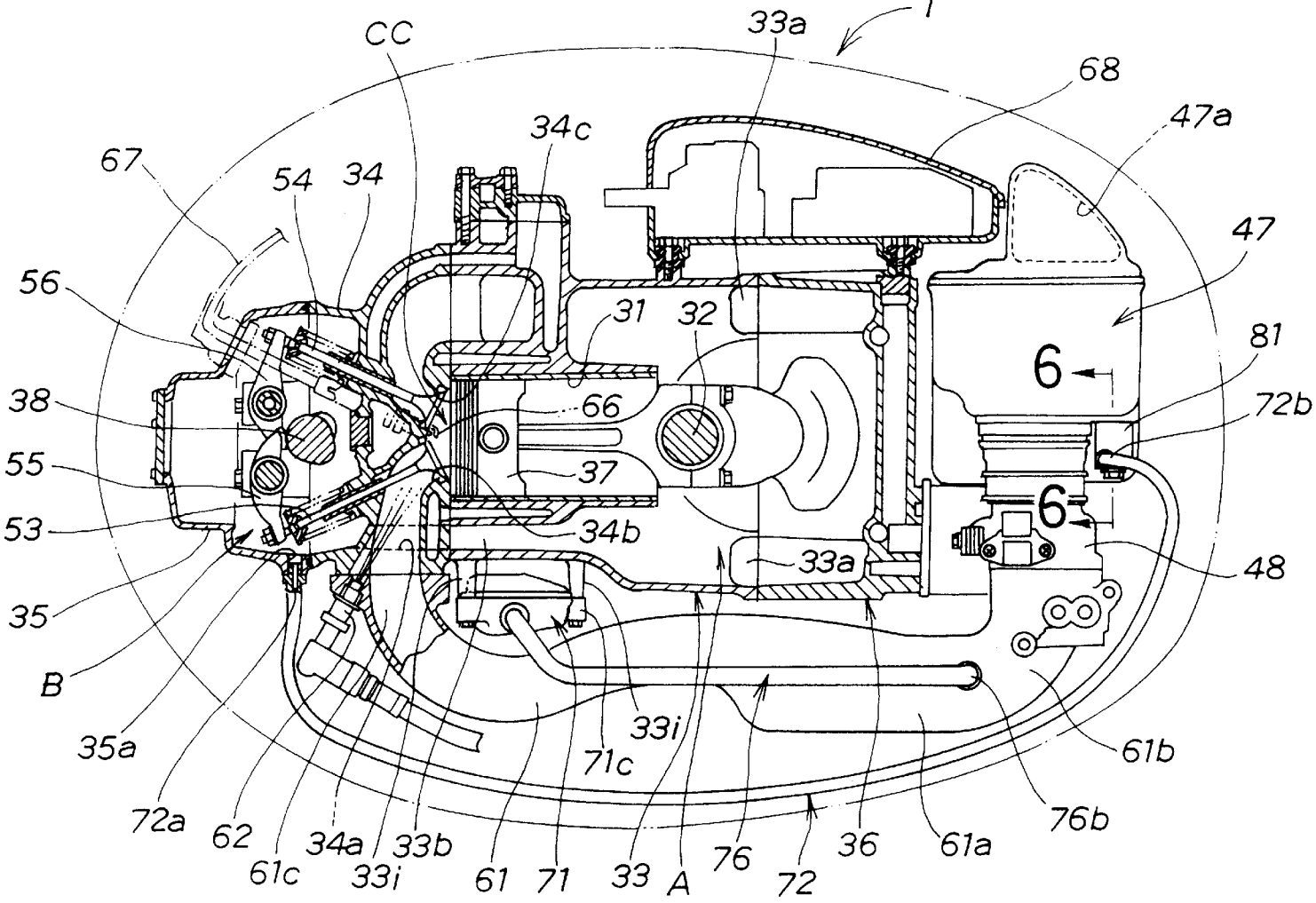
FIG. 3 is a cross-sectional view taken along line 3—3 of FIG. 2.

The camshaft 38 is driven by rotation of the crankshaft 32 through the first pulley 32*a*, the first belt 39 and the driven pulley 38*a*, and whereby valve rocker arms 55, 56 for opening and closing intake valves 53 and exhaust valves 54 pivot, as shown in FIG. 3. Each pair of the intake and exhaust valves 53, 54 for opening and closing an intake port 34*b* and an exhaust port 34*c*, respectively, faces individual combustion chambers cc defined at each top portion of the cylinders 31.

Referring to FIG. 3, reference numerals 33*a*, 33*a* each denote a part of a passage, provided sidewardly of a bearing portion for the crankshaft 32, for connecting the crank room A to the oil pan 24 positioned below the crank room A.

The engine 3 will be described in more detail with reference to FIGS. 2 and 3. Fuel injector valves 62 are provided for supplying fuel to the respective combustion chambers cc via a downstream portion of an intake manifold 61. Reference numeral 66 designates an ignition plug provided in each combustion chamber cc; 67, a high-tension cord; and 68, an electric parts box for accommodating an ignition coil and an ECU.

Within the cylinder head 34, a plurality of breather passages 34*a* are provided at a side close to the intake manifold 61 while within the cylinder block 33, a passage 33*b* is provided coaxially with the breather passage 34*a*. The breather passage 34*a* cooperates with the passage 33*b* to thereby bring the crank room A into communication with the cam chamber B.

Since the crank room A communicates with the cam chamber B through the breather passage 34*a* and the passage 33*b*, it becomes possible to reduce a change in pressure (pulsation) within the crank room A.

In the described embodiment of the present invention, the four intake manifolds 61 as best shown in FIG. 2 are disposed closely to one side of the cylinder block 33 so that downstream ends 61*c* of the intake manifolds 61 can be provided at the same side of the cylinder head 34 as the side of the cylinder block 33 while upstream ends thereof can also be provided at the same side of the crankcase 36 as the side of the cylinder block 33.

The intake manifolds 61 are vertically juxtaposed with their upstream ends meeting at a surge tank 61*a* having capacity at a portion located closely to the crankcase 36 positioned at the right side in the figure. The surge tank 61*a* includes upstream ends connected via a generally L-shaped elbow portion 61*b* having a reduced diameter as shown in FIG. 4 to the above-mentioned throttle valve device 48 including therein a throttle valve 48*a*.

FIG. 4 is a plan view showing, on an enlarged scale, the induction box 47. At the right side of this figure, there is positioned an induction port 47*a* opening downwardly within the engine 3 of the outboard motor 1. The induction port 47*a* is provided for taking an external air therein.

In FIG. 4, reference numeral 61*d* denotes a mounting boss portion on which an EACV (electric air control valve) is disposed.

Turning again to FIGS. 2 and 3, the downstream ends 61*c* of the four intake manifolds 61 are connected to the respective intake ports 34*b* to thereby supply an air to each of the combustion chambers cc.

The head cover 35 includes a fresh air introducing port 35*a* formed on the side having the intake manifold 61. Such a fresh air introducing port 35*a* is connected to a downstream end 72*a* of a connecting hose 72. The connecting hose 72 includes an upstream end 72*b* connected to the induction box 47.

By thus connecting the upstream end 72*b* to the induction box 47, an air within the induction box 47 flows slowly and thus the induction box 47 is not much influenced by an induction negative pressure generated in the induction box 47 during an intake stroke.

Figure 6:
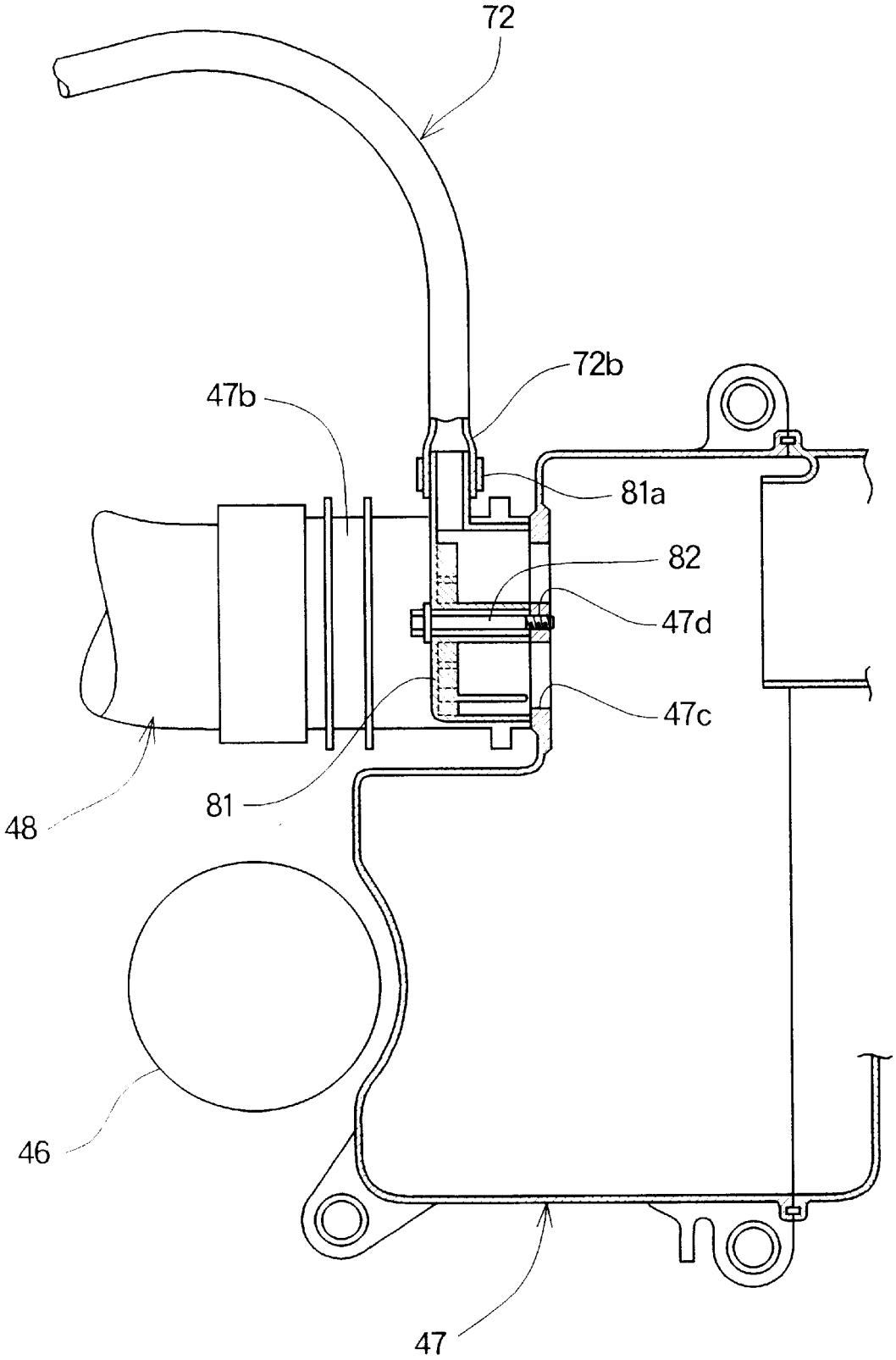
FIG. 6 is an enlarged cross-sectional view taken along line 6—6 of FIG. 3.
Figure 7:
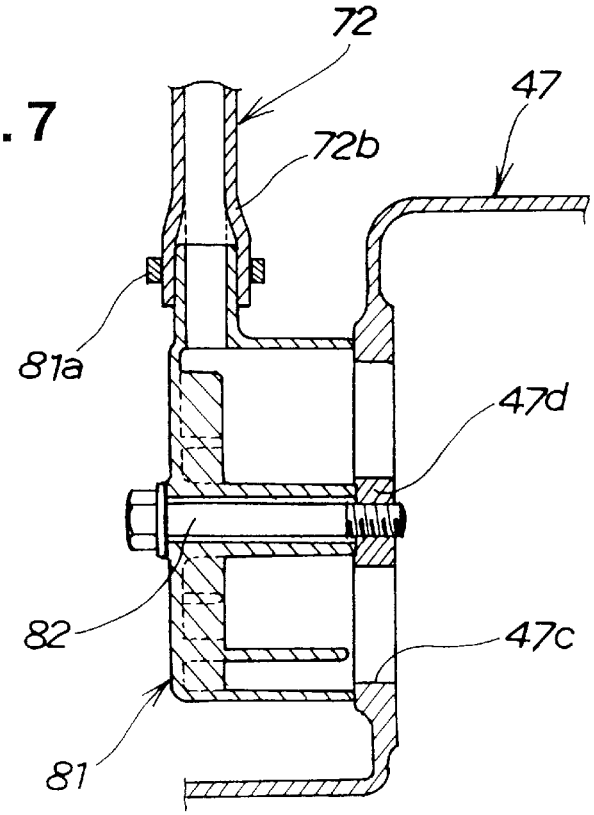
FIG. 7 is an enlarged view illustrting relevant portions of FIG. 6.

FIG. 6 illustrates a relation between the induction box 47 and the throttle valve device 48. The induction box 47 includes an opening 47*c* formed on one part of a side thereof on which the throttle valve device 48 is provided. A cap-shaped breather case 81 for closing the opening 47*c* projects outwardly from the opening 47*c*. The breather case 81 is detachably connected to a boss portion 47*d* by screwing a bolt 82 into the boss portion 47*d* as best shown in FIG. 7. There is provided a connecting tube portion 81*a* extruding upwardly from the breather case 81. The connecting tube portion 81*a* is connected to an upstream end 72*b* of the connecting hose 72.

Detachment of the breather case 81 from the boss portion 47*d* enables maintenance of the connecting hose 72 and the connection between the breather case 81 and the induction box 47. Reference numeral 47*b* designates a connection tube for connecting the throttle valve device 48 to the induction box 47.

The induction box 47 is connected to the cam chamber B through the connecting hose 72 as described above. Further, the cam chamber B is connected to the crank room A through the breather passages 34*a* and passages 33*b*, as stated above. Therefore, it becomes possible to supply a fresh air to the cam chamber B, the breather passages 34*a*, the passages 33*b* and the crank room A via the connecting hose 72 forming a fresh air introducing passage.

The cam chamber B defines a breather room. Inside the head cover 35, a partition plate 35*b* for separating oil in the cam chamber B is provided rearwardly of the head cover 35, as shown in FIG. 2. An used lubricating oil and an extra oil drop and are then recovered to the oil pan 24 positioned below the head cover 35 via an oil returning passage 34*d* provided within the cylinder head 34 and a discharging passage portion 35*c* provided at a lower end of the head cover 35.

At a side of a lower half of the cylinder block 33 at which the intake manifolds 61 are disposed, a projecting portion 33*c* protruding outwardly is provided integrally with the cylinder block 33.

Figure 5:
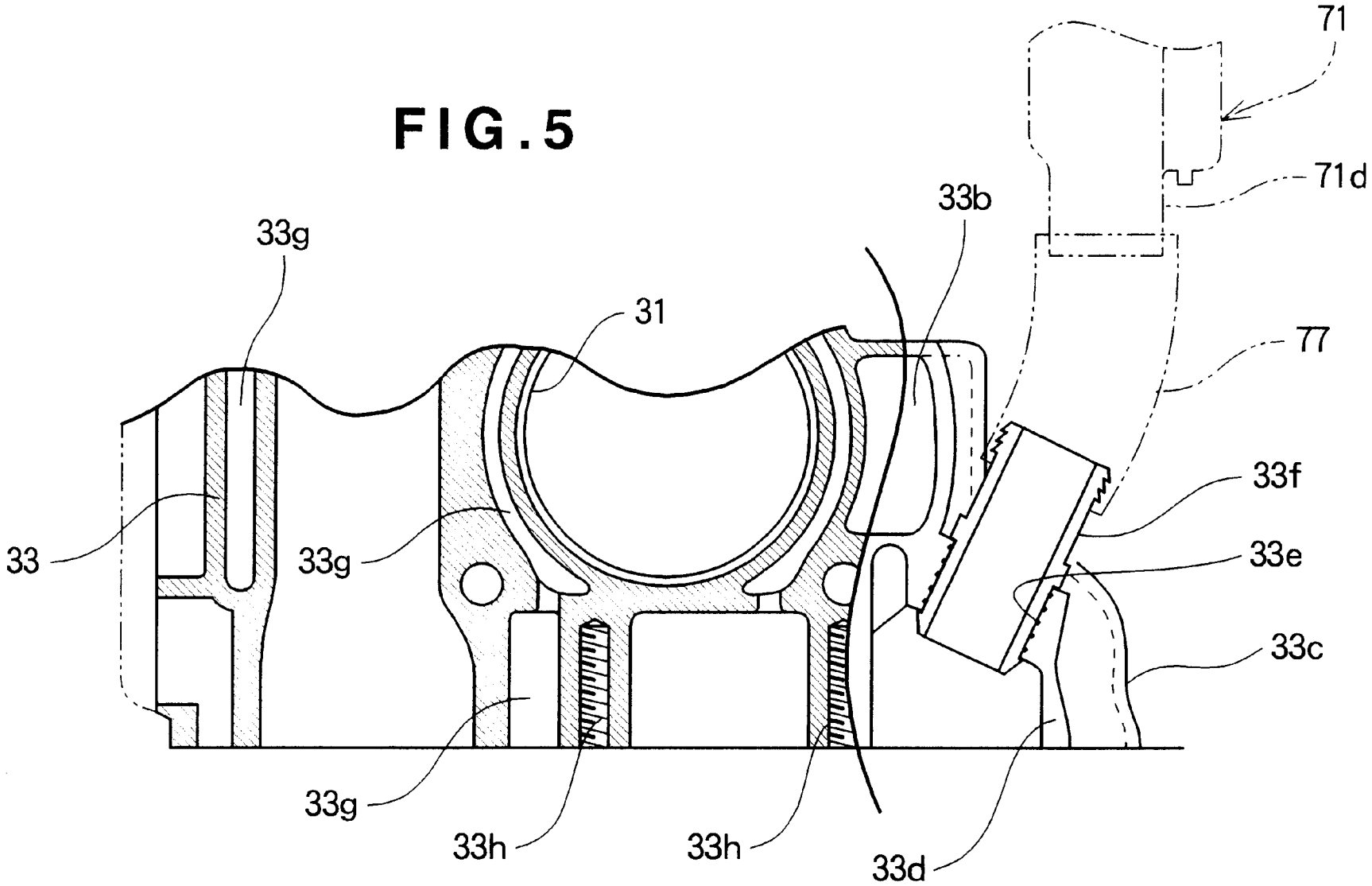
FIG. 5 is an enlarged cross-sectional view taken along line 5—5 of FIG. 2.

Referring to FIG. 5, the projecting portion 33*c* includes a recessed portion 33*d* provided internally thereof. At a top portion of the projecting portion 33*c*, there is provided an opening 33*e* communicating inside and outside of the projecting portion 33*c* with each other. A connection metal fixture 33*f* such as a nipple is fixedly inserted into the opening 33*e*. The metal fixture 33*f* forming a practical opening for the projecting portion 33*c* extends obliquely upwardly.

Reference numeral 33*g* denotes water jackets. 33*h* denotes bolt apertures into which bolts for connecting the engine 3 to the mount case 2 are inserted.

By coupling a combination of the cylinder block 33 and the crankcase 36 to the mount case 2, a top surface of the mount case 2 and a bottom surface of the combination of the cylinder block 33 and the crankcase 36 define internal spaces 2*a*, 2*b* therebetween.

Such an internal space 2*a* defined between the mount case 2 and the combination of the cylinder block 33 and crankcase 36 brings the recessed portion 33*d* into communication with the crank room A and the oil pan 24.

The internal space 2*b* communicates with the oil returning passage 34*d*, the discharging passage portion 35*c* and the oil pan 24.

Between the cylinder block 33 and the intake manifolds 61, a vertically elongated breather chamber 71 for returning a blow-by gas to the intake manifold 61 is vertically disposed closely to the cylinder head 34, as shown in FIG. 3. That is, the breather chamber 71 is positioned leftwardly of the cylinder block 33, as shown in FIG. 2.

Figure 8:
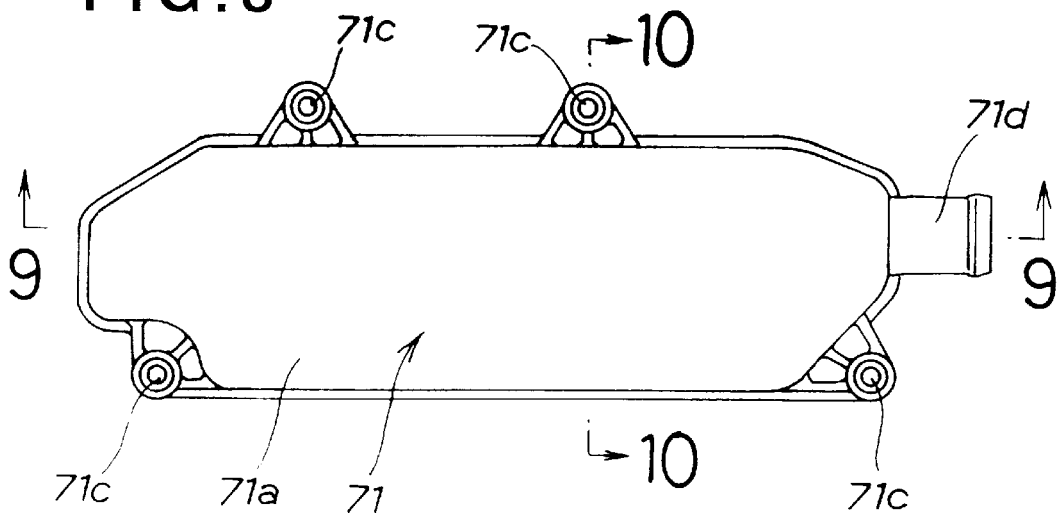
FIG. 8 shows an outer configuration of a breather chamber formed of resin.
Figure 9:
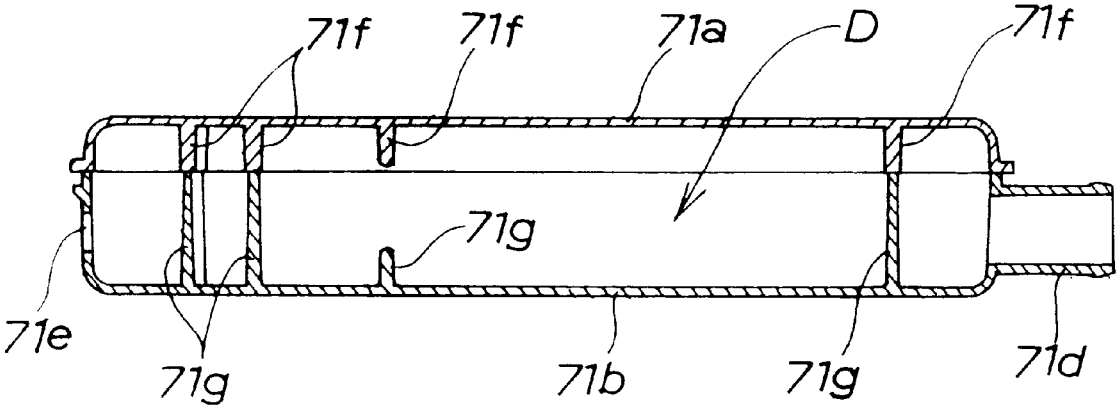
FIG. 9 is a cross-sectional view taken along line 9—9 of FIG. 8.
Figure 10:
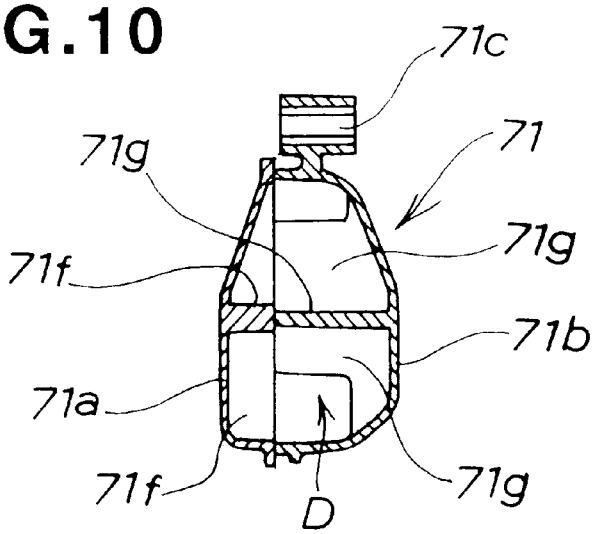
FIG. 10 is a cross-sectional view taken along line 10—10 of FIG. 8.

As shown in FIGS. 8 and 10, the breather chamber 7 comprises a chamber defined by case halves 71*a*, 71*b* shaped from resin and joined together by welding. The breather chamber 71 has a generally rectangular outer configuration as shown in FIG. 8. In FIG. 9, the breather chamber 71 is flatly hollow. Four mounting boss portions 71*c* for bolting the breather chamber 71 to the cylinder block 33 are provided peripherally of the breather chamber 71, as shown in FIG. 8. At an end portion of the breather chamber 71, a cylindrical entrance 71*d* for a blow-by gas is provided in protrusion.

As shown in FIG. 9, an exit 71*e* is provided oppositely from the entrance 71*d*. On opposite inner bottom portions of the upper and lower case halves 71*a*, 71*b*, obstructing plate portions 71*f*, 71*g* are provided for defining a labyrinthine passage in a room D of the breather chamber 71. With this arrangement, it becomes possible to separate an oil mist from a blow-by gas and further increase rigidity of the breather chamber 71.

The cylinder block 33 includes boss portions 33*i* provided sidewardly thereof. The boss portions 33*i* are attached to the vertically disposed breather chamber 71 by means of the mounting boss portions 71*c* with the entrance 71*d* facing downwardly.

As shown in FIGS. 2 and 5, the entrance 71*d* is connected to the metal fixture 33*f* serving as the opening for the projecting portion 33*c*, thereby communicating the crank room A and the breather chamber 71 with each other.

Figure 11:
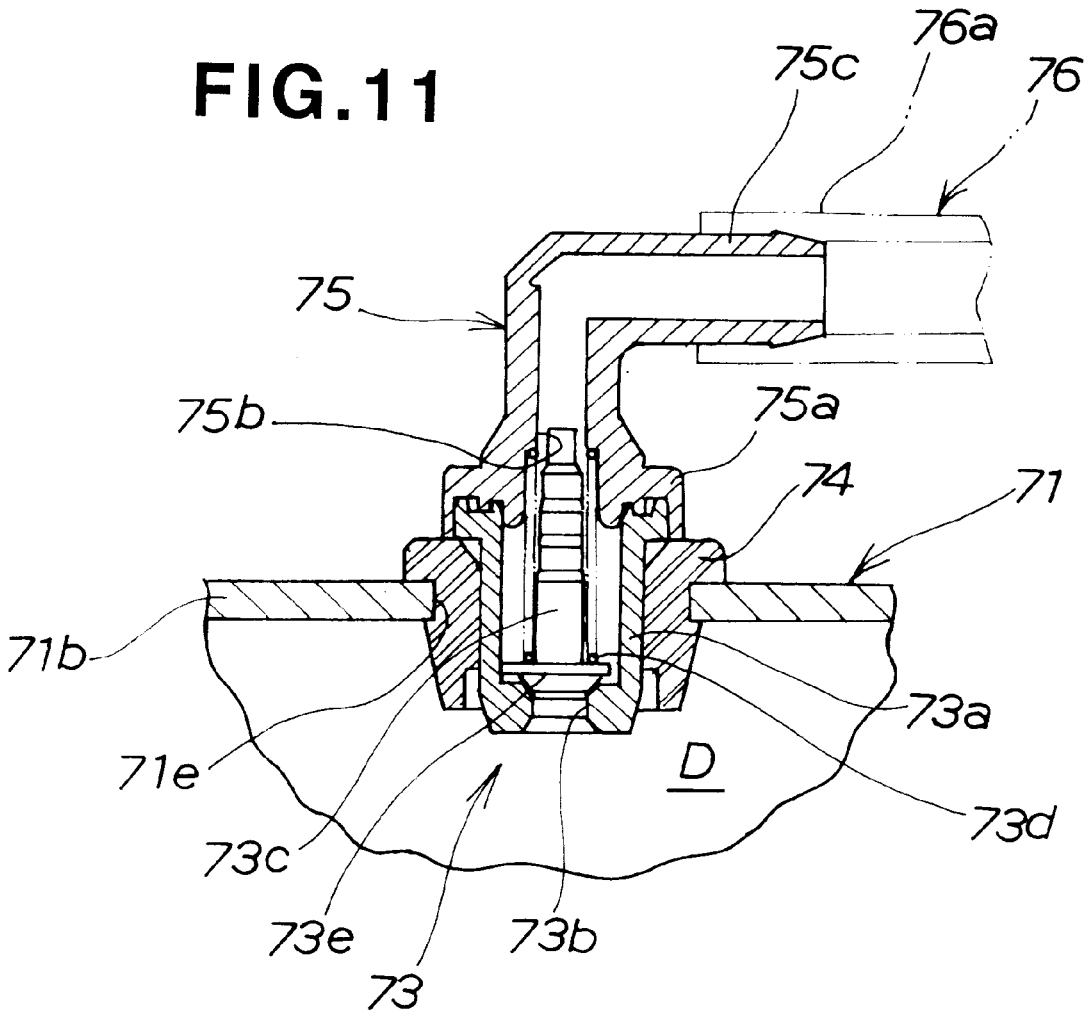
FIG. 11 is an enlarged cross-sectional view showing a regulating valve portion provided between an opening of a downstream exit of the breather chamber and a passage for connecting the breather chamber to an induction passage.

At the exit 71*e* of the breather chamber 71, there is provided a flow rate regulating valve 73 as shown in FIG. 11.

The flow rate regulating valve 73 will now be described in detail with reference to FIG. 11.

The flow rate regulating valve 73 includes its body 73*a* fixed to the exit 71*e* through a grommet 74. The body 73*a* includes a valve aperture 73*b* opening into the room D. Also, the body 73*a* has an outwardly protruding top portion coupled to a base portion 75*a* of an L-shaped connecting tube 75 by, for example, covering the top portion with the base portion 75*a*.

Inside the body 73*a*, there is disposed a valve body 73*c* having the same axial direction as the exit 71*e*. The valve body 73*c* is urged by a spring 73*d* in such a direction as to close the valve aperture 73*b*. The valve aperture 73*b* is opened and closed with a lover valve body 73*e* provided at a lower end of the valve body 73*c*. The valve body 73*c* has an upper half gradually becoming small in diameter. Therefore, a gap between the valve body 73*c* and a base inner diameter portion 75*b* of the connecting tube 75 is reduced by upward movement of the valve body 73*c* with the result that flow rate of a blow-by gas is regulated.

As shown in FIG. 11, the connecting tube 75 includes a sidewardly facing end 75*c* connected to an upstream end 76*a* of a tube 76 forming a PCV passage. The tube 76 extends over the uppermost intake manifold 61 with its downstream end 76*b* connected to the surge tank 61*a* at which the respective intake manifolds 61 meet with each other in the vicinity of the elbow portion 61*b* (see FIG. 3).

As thus far explained, a passage for returning a blow-by gas to the intake manifold 61 is formed. A blow-by gas including an oil mist in the crankcase A is introduced from the recessed portion 33*d* communicating with the crankcase A into the breather chamber 71 through the metal fixture 33*f* forming the opening of the projecting portion 33*c* and a connection hose 77.

In such a case, since the projecting portion 33*c* with the recessed portion 33*d* communicating with the crankcase A projects outwardly, the blow-by gas in the crankcase A is not directly introduced into the breather chamber 71, thereby preventing an oil from flowing into the breather chamber 71 with the result that separation of oil from the blow-by gas is effectuated.

Further, the above-mentioned labyrinthine passage formed by the obstructing plate portions 71*f*, 71*g* within the room D of the breather chamber 71 can also separate oil components from the blow-by gas. As a result, it becomes possible to obtain the blow-by gas with the oil components removed therefrom as much as possible within the breather chamber 71.

An induction negative pressure is applied to the flow rate regulating valve 73 from the tube 76 forming the PCV passage. More specifically, the induction negative pressure is applied to the valve body 73*c* in such a direction as to open the valve aperture 73*b*. Therefore, with such an induction negative pressure, the valve aperture 73*b* is opened to induct a blow-by gas within the room D of the breather chamber 71. Then, the flow rate of the blow-by gas is regulated in accordance with the upward and downward movements of the valve body 73*c*.

The blow-by gas passed through the breather chamber 71 is introduced into the upstream ends of the intake manifolds 61 via the tube 76 forming thy PCV passage to thereby join a fresh air supplied from the induction box 47. Thereafter, the blow-by gas is fed into the combustion chambers cc together with the fresh air.

Accordingly, a substantial amount of the oil components is removed from the blow-by gas and hence the blow-by gas to be introduced into the intake manifolds 61 becomes clean.

Obviously, various minor changes and modifications of the present invention are possible in the light of the above teaching. It is therefore to be understood that within the scope of the appended claims, the present invention may be practiced otherwise than as specifically described.

What is claimed is:

1. A four-cycle engine for an outboard motor, having a crank room for accommodating a crankshaft disposed substantially vertically, a cylinder block having an axis extending substantially horizontally, a crankcase formed of two halves and coupled to said cylinder block, a cylinder head coupled to said cylinder block, a head cover coupled to said cylinder head to form a cam chamber for housing therein a substantially vertically disposed camshaft driven by said crankshaft, an induction passage having a throttle valve and communicating with combustion chambers formed at least partially by said cylinder head, and an oil pan provided below at least said cylinder block and communicating with said crank room and said cam chamber for storing a lubricating oil from said crank room and said cam chamber, said four-cycle engine comprising:

a breather passage formed in said cylinder block and said cylinder head and communicating said crank room and said cam shaft with each other;

a fresh air introducing passage for supplying a fresh air to said crank room via said breather passage provided in said cylinder block with one end thereof communicating with said cam chamber and the other end thereof communicating with said induction passage;

a projecting portion disposed at a side of a lower half of said cylinder block and having an inside of recessed configuration opening to a bottom surface of said cylinder block and communicating with said oil pan;

a breather chamber disposed sidewardly of said cylinder block and above said projecting portion and extending upwardly to communicate with the inside of said projecting portion through an opening provided in said projecting portion; and a PCV passage communicating with an upper portion of said breather chamber and with said induction passage which communicates with said combustion chambers formed at least partially by said cylinder head.

2. A four-cycle engine for an outboard motor, according to claim 1, wherein said induction passage is disposed sidewardly of said cylinder block and extends over an area from the cylinder head to the crankcase, and said breather chamber is disposed internally of said induction passage.

3. A four-cycle engine for an outboard motor, according to claim 1 or 2, wherein said breather chamber is formed by welding halved members made of resin.

* * * * *